US006417622B2

(12) United States Patent
Theiss

(10) Patent No.: US 6,417,622 B2
(45) **Date of Patent: *Jul. 9, 2002**

(54) BROADBAND, INVERTED SLOT MODE, COUPLED CAVITY CIRCUIT

(75) Inventor: Alan J. Theiss, Redwood City, CA (US)

(73) Assignee: Northrop Grumman Corporation, Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/231,058

(22) Filed: Jan. 14, 1999

(51) Int. Cl.[7] ..... H01J 23/087; H01J 25/10; H01J 25/34

(52) U.S. Cl. ..... 315/3.5; 315/5.35; 315/5.39

(58) Field of Search ..... 315/3.5, 5.35, 315/5.39

(56) References Cited

U.S. PATENT DOCUMENTS

| | | | | |
|---|---|---|---|---|
| 2,966,610 A | * | 12/1960 | Schmidt et al. | 315/3.5 |
| 3,011,085 A | * | 11/1961 | Caldwell, Jr. | 315/3.5 |
| 3,309,630 A | * | 3/1967 | Hukunaga | 315/3.5 X |
| 3,668,460 A | * | 6/1972 | James | 315/3.5 |
| 3,684,913 A | | 8/1972 | James et al. | |
| 3,989,978 A | * | 11/1976 | Sauseng et al. | 315/3.5 |
| 4,307,322 A | | 12/1981 | Chaffee et al. | |
| 4,746,833 A | | 5/1988 | King et al. | |
| 4,931,694 A | | 6/1990 | Symons et al. | |
| 5,332,947 A | | 7/1994 | Theiss et al. | |
| 5,469,022 A | * | 11/1995 | Begum et al. | 315/5.39 |
| 5,534,750 A | | 7/1996 | Theiss et al. | |

OTHER PUBLICATIONS

"The Ground Station High–Power Traveling–Wave Tube", By Collier et al., The Bell System Technical Journal, Jul. 1963, pp 1829–1861.

"A Coupled–Cavity TWT Operating In The Inverted Slot Mode", By Frey et al., IEEE, 1981, pp 504–506.

"A BWO For 75 To 115 GHz", By Schneider et al., Siemens AG Bereich Röhren, München (09/70).

"Vergleich Von Verzögerungsleitungen Für Hochleistungs–Wanderfeldröhren", By Gross et al., Werk für Röhren der Siemens AG, München, pp 61–66.

* cited by examiner

*Primary Examiner*—Benny Lee
(74) *Attorney, Agent, or Firm*—O'Melveny & Myers LLP

(57) ABSTRACT

A coupled cavity circuit for a microwave electron tube comprises at least two resonant cavities adjacent to each other. An electron beam tunnel passes through the coupled cavity circuit to allow a beam of electrons to pass through and interact with the electromagnetic energy in the cavities. An iris connecting the adjacent cavities allows electromagnetic energy to flow from one cavity to the next. The iris is generally symmetrical about a perpendicular axis of the electron beam tunnel with the iris having flared ends and a central portion connecting the flared ends. The iris shape causes the iris mode passband to be lower in frequency than the cavity mode passband while still providing broadband frequency response.

28 Claims, 11 Drawing Sheets

BROADBAND, INVERTED SLOT MODE, COUPLED CAVITY CIRCUIT

BACKGROUND OF THE INVENTION

1. Field of the Invention

The present invention relates to microwave amplification tubes, such as traveling wave tubes or klystrons, and more particularly, to a coupled cavity microwave electron tube that produces an inverted slot mode and broadband response.

2. Description of Related Art

Microwave amplification tubes, such as a traveling wave tube (TWT) or klystron, are well known in the art. These devices are designed so that a radio frequency (RF) signal and an electron beam are made to interact in such a way as to amplify the power of the RF signal. A coupled cavity TWT typically includes a series of tuned cavities that are linked or coupled by irises (also called notches or slots) formed between the cavities. A microwave RF signal induced into the tube propagates through the tube, passing through each of the respective coupled cavities. A typical coupled cavity TWT may have thirty or more individual cavities that are coupled in this manner. Thus, the TWT appears as a folded waveguide and the meandering path that the RF signal takes as it passes through the coupled cavities of the tube reduces the effective speed of the signal so that the electron beam can effectively operate upon the signal. Thus, the reduced velocity waveform produced by a coupled cavity tube of this type is known as a "slow wave."

Each of the cavities is further linked by an electron beam tunnel which extends the length of the tube and through which an electron beam is projected. The electron beam is guided by magnetic fields which are induced in the beam tunnel region and the folded waveguide guides the RF field periodically back and forth across the drifting electron beam. Thus, the electron beam interacts with the RF signal as it travels through the tube to produce the desired amplification by transferring energy from the electron beam to the RF wave.

Klystrons are similar to coupled cavity TWTs in that they can comprise a number of cavities through which an electron beam is projected. The klystron amplifies the modulation on the electron beam to produce a highly bunched beam containing a RF current. A klystron differs from a coupled cavity TWT in that the klystron cavities are not generally coupled. A portion of the klystron cavities may be coupled, however, so that more than one cavity can interact with the electron beam. This particular type of klystron is known as an extended interaction output klystron.

For a coupled cavity circuit, the bandwidth over which the amplification of the resulting RF output signal occurs can be controlled by altering the dimensions of the cavities and irises, and the power of the RF output signal can be controlled by altering the voltage and current characteristics of the electron beam. More specifically for the bandwidth, as the cavity narrows it propagates higher frequencies and as the iris narrows it propagates fewer frequencies.

There are generally two frequency bands of interest in which propagation can occur. The lower frequency band is referred to as the "cavity passband" because its characteristics are controlled largely by the cavity resonance condition. The upper frequency band is referred to as the "iris passband" and its characteristics are controlled mainly by the iris resonance condition. Normally, the cavity passband is used for interaction with the electron beam. As the length of the iris increases, the cavity resonance condition, usually appearing at the $2\pi$ point on the lower passband of the dispersion curves, changes position with the iris resonance condition that appears at the $2\pi$ point on the upper passband. When this passband mode inversion occurs (cavity passband and iris passband trading relative positions—also known as inverted slot mode), it provides an advantage in preventing drive-induced oscillations and thus no special oscillation suppression techniques are required. Note that the mechanism of exciting the oscillations with a decelerating beam crossing a cavity resonance point is well known.

Unfortunately, to produce this passband mode inversion, the iris length is usually to such an extent that it wraps around the electron beam tunnel. This has the disadvantage of introducing transverse magnetic fields when the iris lies in an iron pole piece. Furthermore, a significant problem with RF amplification tubes is the efficient removal of heat. As the electron beam drifts through the tube cavities, heat energy resulting from stray electrons intercepting the tunnel walls must be removed from the tube to prevent reluctance changes in the magnetic material, thermal deformation of the cavity surfaces, or melting of the tunnel wall. The excessive iris length and corresponding reduction in the amount of metal results in a longer heat flow path around the iris. Thus the ability to remove heat is significantly reduced along with the overall coupled cavity circuit's thermal ruggedness.

Accordingly, it would be desirable to provide a coupled cavity circuit having an iris that produces the passband mode inversion without the excessive iris length. Also, it would be desirable for the coupled cavity circuit to have a broadband frequency response while preventing drive-induced oscillations so that no special oscillation suppression techniques are required. Furthermore, it would be desirable for such a coupled cavity circuit to offer a significant increase in the amount of metal that is provided around the electron beam tunnel such that a passband mode inversion occurs without an increase in transverse magnetic fields or degradation in thermal ruggedness.

SUMMARY OF THE INVENTION

In accordance with the teachings of the present invention, a coupled cavity circuit is provided with an iris that produces passband mode inversion such that the iris mode passband is at a lower frequency than the cavity mode passband. In addition, the coupled cavity circuit also provides broadband frequency response while preventing drive-induced oscillations so that no lossy material is required within the coupled cavity circuit. Furthermore, the coupled cavity circuit provides these advantages without requiring an excessive iris length and thus avoids any severe increase in transverse magnetic fields or degradation in thermal ruggedness.

In an embodiment of the present invention, a microwave electron tube, such as a traveling wave tube or an extended interaction klystron, comprises an electron gun for emitting an electron beam through an electron beam tunnel to a collector that collects the electrons from the electron beam. A slow wave structure is disposed along the electron beam path and defines an electromagnetic path along which an electromagnetic signal interacts with the electron beam. The slow wave structure has at least one coupled cavity circuit comprising at least one iris disposed between a first cavity and a second cavity for coupling the electromagnetic signal between the first cavity and the second cavity. The iris is disposed between the electron beam tunnel and a sidewall of the tube with the iris being symmetrical about a perpendicular axis of the electron beam tunnel. The iris has a center portion with a first width and flared ends with a second width that is greater than the first width. The flared ends wrapping partially around the electron beam tunnel.

In a second embodiment of the present invention, the coupled cavity circuit of the slow wave structure has a rectangular shape. The iris has a rectangular central portion that extends substantially across one sidewall of the tube. The iris has flared ends that form a triangular region at each end of the central portion. The triangular regions have a hypotenuse that is adjacent to the electron beam tunnel and a side that extends part way along a sidewall of said tube that is adjacent to the one sidewall of the tube.

If there is more than one coupled cavity circuit, the irises can be in line, staggered, or on opposite sides of the tube. There can also be more than one iris per coupled cavity circuit with the irises in line or staggered from each other. The iris shape provides the inverted slot mode condition and broadband response without excessive iris length.

A more complete understanding of the coupled cavity circuit will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

The present invention satisfies the need for a coupled cavity circuit that provides passband mode inversion without requiring an excessive iris length. As a result, the coupled cavity circuit provides broadband response without introducing a severe increase in transverse magnetic fields or degradation in thermal ruggedness. Furthermore, the coupled cavity circuit prevents drive-induced oscillations and therefore no special oscillation suppression techniques such as lossy material is required in the circuit. In the detailed description that follows, like element numerals are used to describe like elements illustrated in one or more of the figures.

Figure 1:
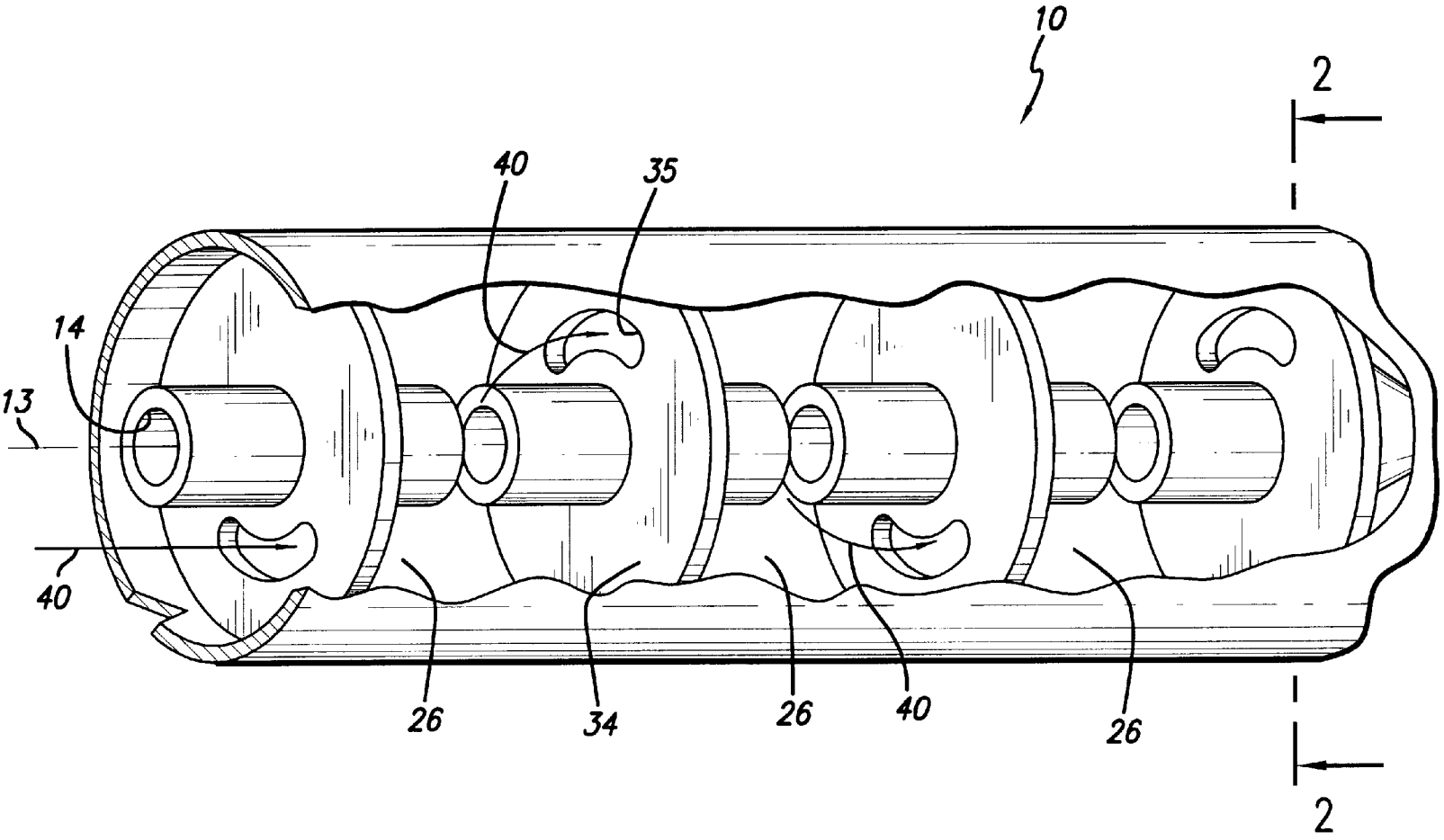
FIG. 1 PRIOR ART
FIG. 1 is a partial perspective view of a typical coupled cavity portion of a cylindrical microwave electron tube.

Referring first to FIG. 1, a typical coupled cavity cylindrical traveling wave tube 10 is shown. Because the coupled cavity section may be of any desired length, the coupled cavity TWT 10 is shown broken away from an input or output section of the TWT. In addition, although the coupled cavity TWT 10 is shown as being cylindrical in shape, it should be understood that the coupled cavity TWT 10 may alternatively be rectangular or any other shape, as known in the art. The coupled cavity structure includes a plurality of adjacent cavities 26 separated by polepieces 34. The polepieces 34 comprise disk shaped elements dividing the cylindrical shaped cavities 26. The cavities 26 are coupled by coupling irises 35 that extend through a portion of each of the polepieces 34, thus providing a meandering path 40 for the traveling RF wave. An electron beam tunnel 14 extends along an axis of the TWT through a central portion of each polepiece 34 permitting passage of an electron beam 13 through each cavity 26.

Figure 2:
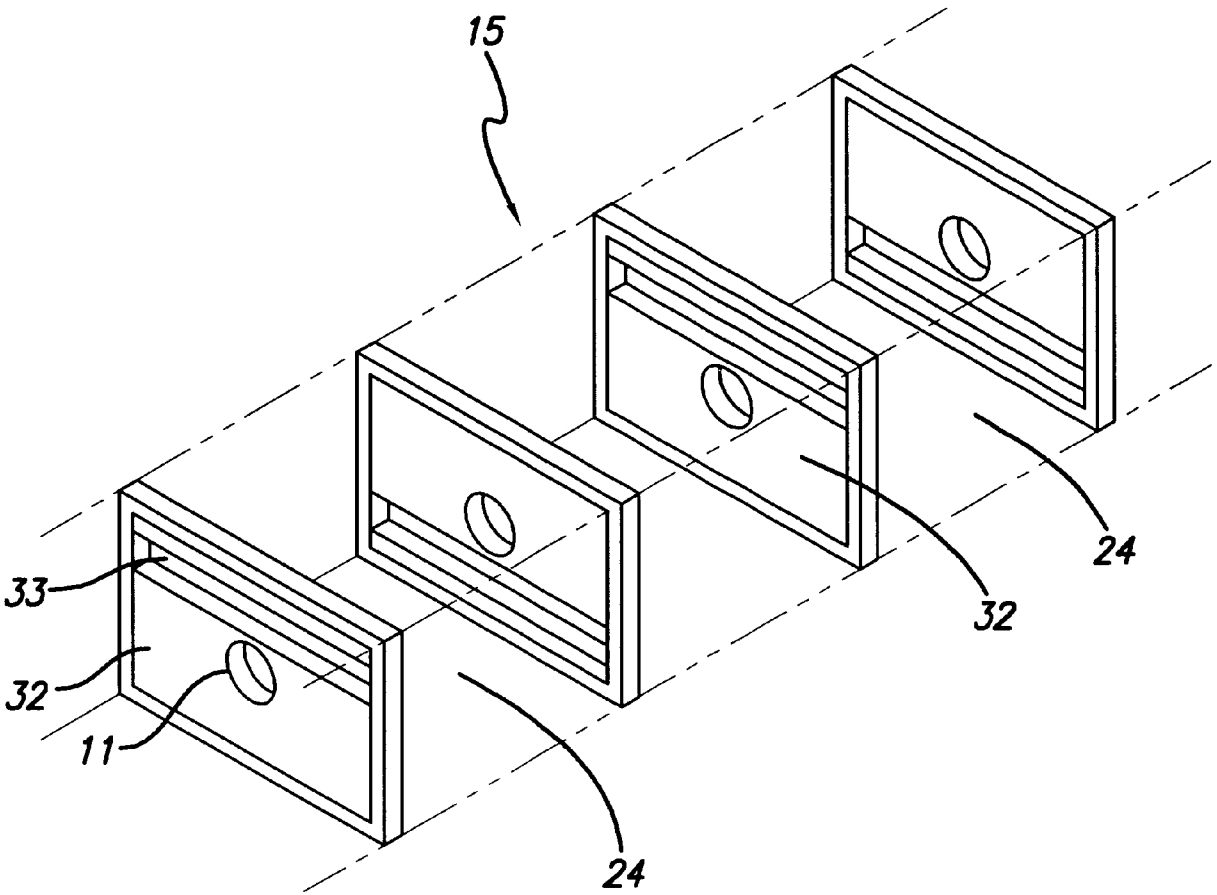
FIG. 2 PRIOR ART
FIG. 2 is a partial perspective view of a typical coupled cavity portion of a rectangular microwave electron tube.

FIG. 2 is a typical coupled cavity rectangular traveling wave tube 15 and, as with FIG. 1, is shown broken away from an input or output section of the TWT. The coupled cavity structure for the coupled cavity TWT 15 includes a plurality of adjacent cavities 24 separated by rectangular polepieces 32. The rectangular polepiece 32 has an iris 33 and an electron beam tunnel 11. As seen in FIG. 2, the iris 33 is typically rectangular in shape to correspond with the rectangular shape of the coupled cavity TWT 15.

Figure 3A:
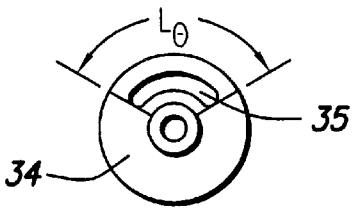
FIG. 3a PRIOR ART
FIGS. 3*a*, 3*b*, and 3*c* are cross-sectional views of a polepiece taken along line 2—2 of FIG. 1.
Figure 3B:
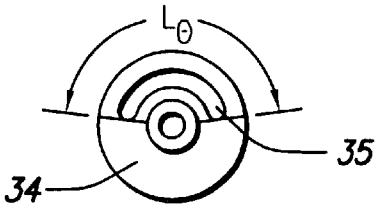
FIG. 3b PRIOR ART
Figure 3C:
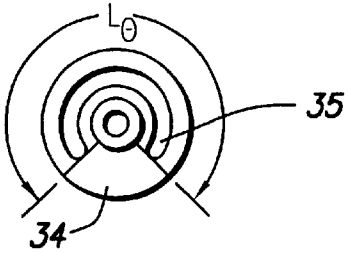
FIG. 3c PRIOR ART
Figure 4A:
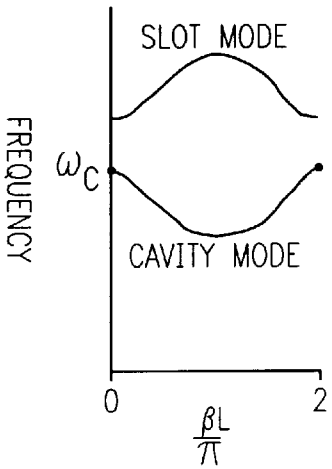
FIGS. 4*a*, 4*b*, and 4*c* are graphs illustrating the passband mode inversion that occurs as the iris length increases.
Figure 4B:
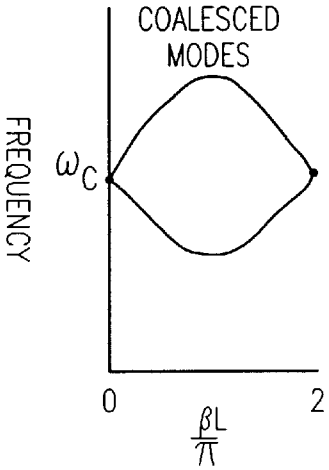
Figure 4C:
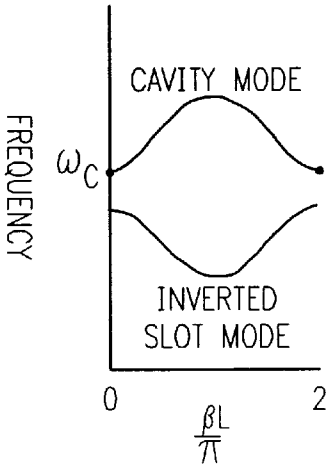

Referring now to FIGS. 3*a*, 3*b*, and 3*c*, each figure shows a cross sectional view, taken along line 2—2 of FIG. 1, of the polepiece 34. Above each polepiece 34, the respective length of the iris 35 is illustrated by $L_\theta$ where $L_\theta$ is the iris circumference length for a corresponding iris angle $\theta$ with origin centered at the electron beam tunnel. As discussed above, as the iris length $L_\theta$ varies, this changes the relative positions of the cavity mode passband and iris mode passband. This change in relative positions of the passbands is illustrated by the graphs of FIGS. 4*a*, 4*b*, and 4*c*. Specifically, FIGS. 4*a*, 4*b*, and 4*c* graph the coupled cavity circuit response for frequency ($\omega_c$) versus the normalized wave number (wave number $\beta$ times the circuit period L divided by $\pi$) generated by the respective iris length $L_\theta$ of FIGS. 3*a*, 3*b*, and 3*c*.

FIG. 3*a* illustrates the typical iris length $L_\theta$ and FIG. 4*a* illustrates the corresponding coupled cavity circuit operation for the iris length $L_\theta$ shown in FIG. 3*a*. As can be seen in the graph of FIG. 4*a*, the cavity mode passband is lower in frequency than the slots mode passband. In this configuration, the cavity mode passband is typically the passband used to interact with the electron beam. As the iris length $L_\theta$ increases, the cavity mode passband and slots mode passband migrate closer to each other until the two unite, as shown in FIG. 4*b* for the corresponding iris length $L_\theta$ of FIG. 3*b*. When the two modes merge, this is referred to as the coalesced mode.

As the iris length continues to increase, the cavity mode passband becomes the upper frequency band and the slots mode passband becomes the lower frequency band, as shown in FIG. 4*c* for the corresponding iris length $L_\theta$ of FIG. 3*c*. This is referred to as inverted slot mode or passband mode inversion. Passband mode inversion allows the slots mode passband to function as the primary passband for interaction with the electron beam. Furthermore, passband mode inversion prevents drive-induced oscillations because, for the slots mode passband, the interaction impedance at the upper cutoff frequency is zero due to the vanishing axial electric field component on the axis. Thus, for the slots mode passband, no special oscillation suppression techniques are required such as lossy material placed within the coupled cavity circuit.

However, FIG. 3*c* shows that the iris length $L_\theta$ required to induce passband mode inversion is extensive. The iris within the polepiece wraps almost completely around the electron beam tunnel. This has the disadvantage of introducing transverse magnetic fields when the iris lies in an iron pole piece. In addition, due to current interception, heat is generated on the electron beam tunnel wall. Thus, the long iris length results in a longer heat flow path around the iris and therefore causes a decrease in the coupled cavity circuit's thermal ruggedness.

Figure 5:
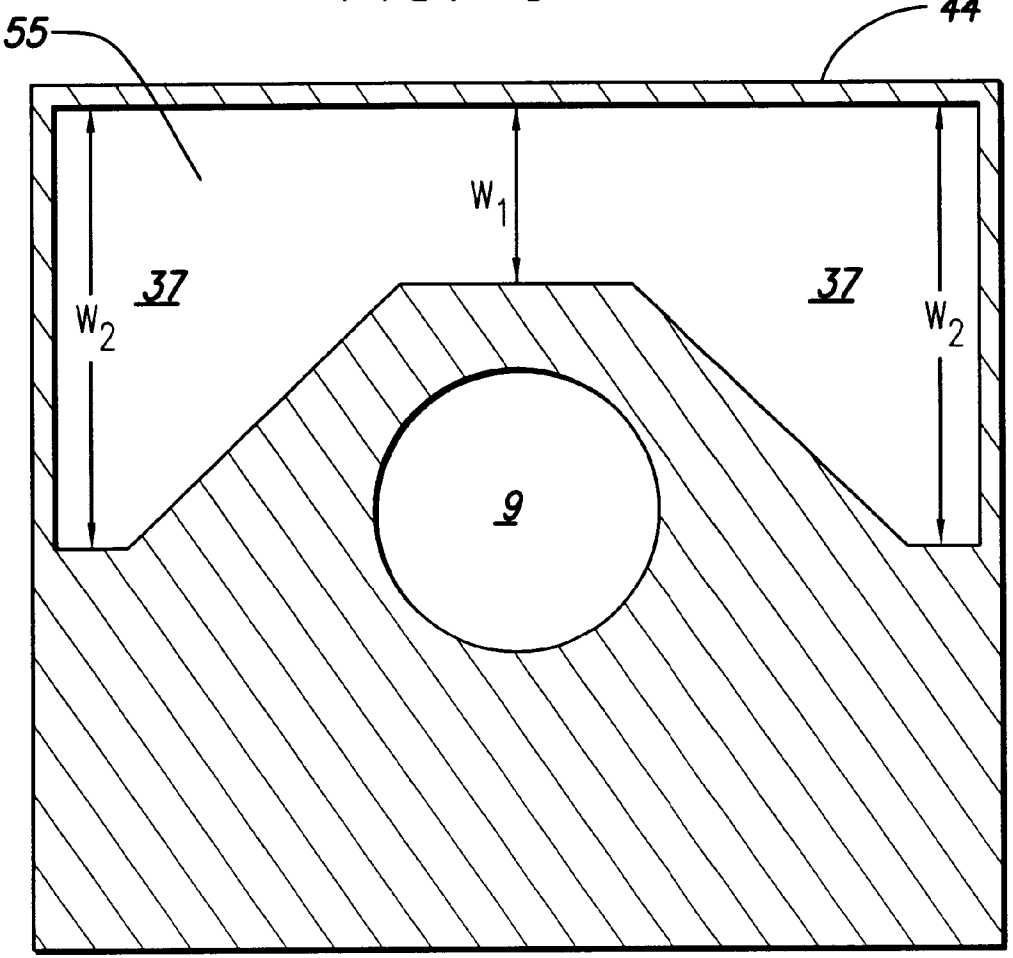
FIG. 5 is a cross-sectional view of a rectangular polepiece showing an iris according to an embodiment of the present invention.

Referring now to FIG. 5, a rectangular polepiece 44 for a coupled cavity circuit shows the iris 55 according to an embodiment of the present invention. The large triangular opening 37 with a width $W_2$, on each end of the iris 55, increases both the bandwidth and the impedance of the circuit. This results, as noted above, because a broader iris allows the propagation of a greater number of frequencies. The iris 55 has an iris center width $W_1$. The narrow separation of the iris center width $W_1$ increases the iris capacitance and thereby lowers the iris resonance frequency so that the coupled cavity circuit becomes stable in reference to drive-induced oscillations. Thus, the iris 55 induces passband mode inversion so that the iris mode passband is used to interact with the electron beam traveling through an electron beam tunnel 9. Furthermore, the shape of the iris 55 induces the passband mode inversion without requiring the excessive iris length, such as illustrated in FIG. 3*c* for the prior art, and thus there is no severing of the magnetic flux from the periodic permanent magnet (PPM) focusing fields.

As can be seen in FIG. 5, the iris 55 according to an embodiment of the present invention has a much shorter iris length relative to the circumference of the electron beam tunnel 9 than in typical prior art irises such as illustrated in FIG. 3*c*. The iris 55 thus produces passband mode inversion without the disadvantages discussed above. The shorter iris length results in a shorter heat flow path out from the electron beam tunnel wall and thus the coupled cavity circuit's thermal ruggedness is increased. Furthermore, the shorter iris length reduces any significant increase in transverse magnetic fields when the iris lies in an iron polepiece.

Figure 6:
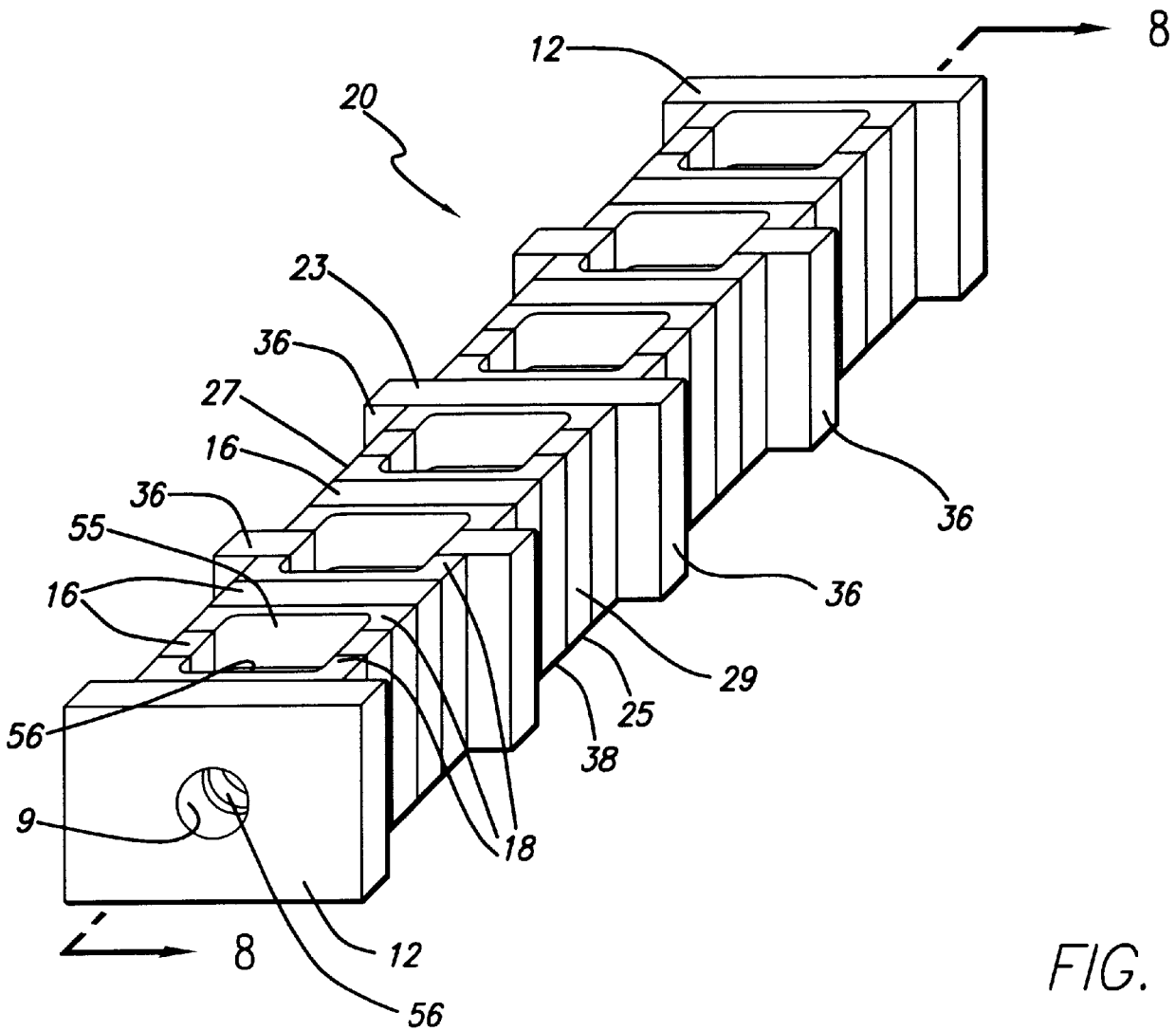
FIG. 6 is a perspective view of an integral polepiece RF amplification tube utilizing an iris according to an embodiment of the present invention.

Referring now to FIG. 6, a perspective view of an integral polepiece RF amplification tube 20 is shown utilizing an iris in accordance with an embodiment of the present invention. The tube 20 comprises a plurality of non-magnetic plates 18 and magnetic plates 16 (also known as polepieces) which are alternatingly assembled and integrally formed together. The assembled tube 20 has end plates 12 disposed on either end and an electron beam tunnel 9 that extends through the end plates 12 and fully lengthwise through the tube 20. The tube 20 has a top 23 and a bottom 25 opposite the top 23 that provide a planar surface for attachment of a heat sink. The tube 20 has a one side 27 and a second side 29 opposite the one side 27 which are flush with edges of the non-magnetic plates 18 and the polepieces 16 except for individual ones of the polepieces 16 that extend outward from the one side 27 and the second side 29 to provide ears 36. The ears 36 provide a mounting position 38 for the installation of magnets (not shown). A more detailed description of integral polepiece RF amplification tubes is given in U.S. Pat. Nos. 5,332,947 and 5,534,750 and these are hereby incorporated by reference.

Figure 8:
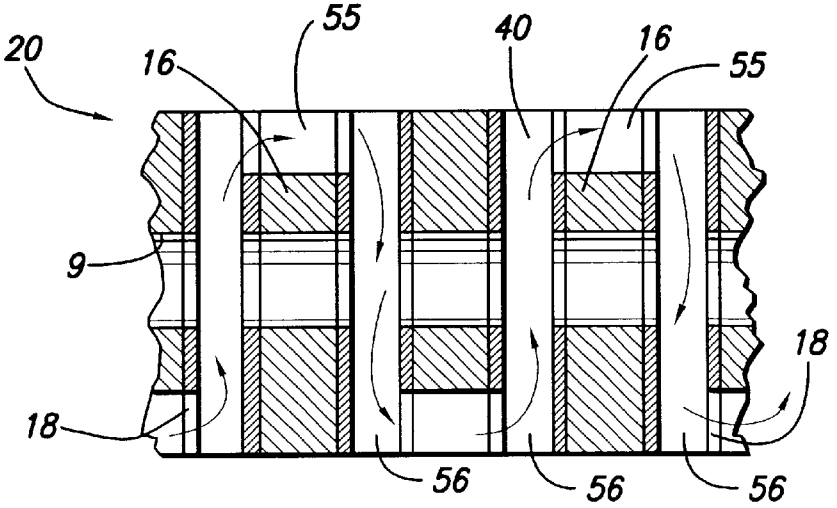
FIG. 8 is a cross-sectional view of the interior of the integral polepiece RF amplification tube, as taken through the Section 8—8 of FIG. 6.
Figure 7:
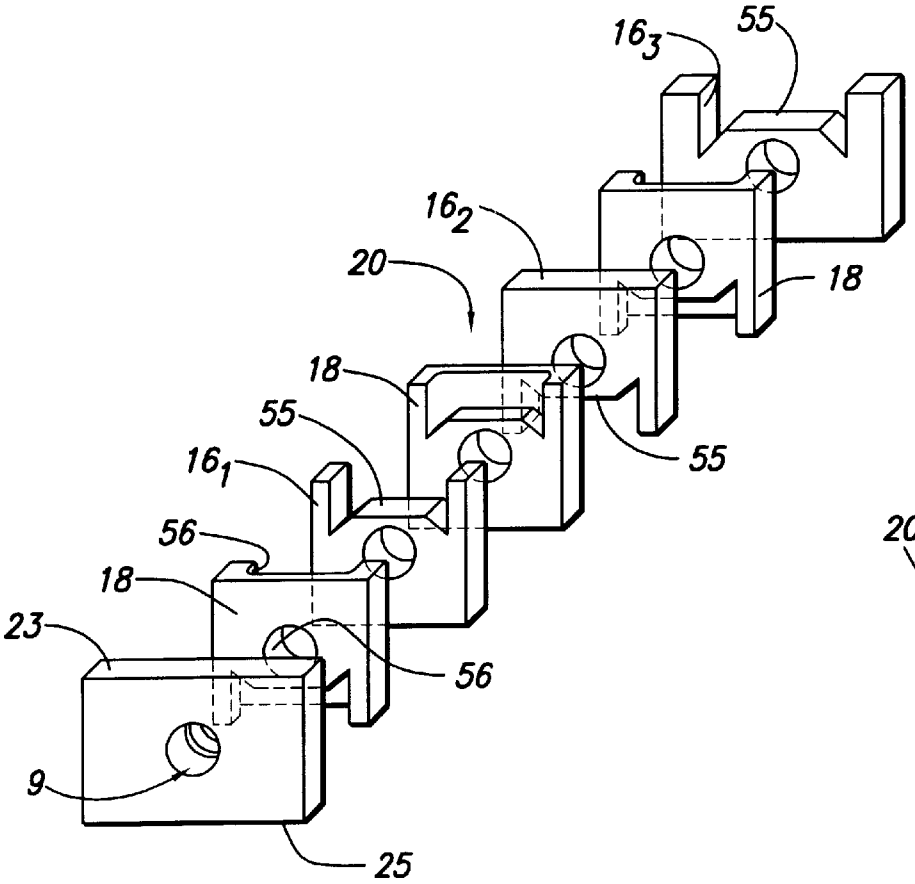
FIG. 7 is an exploded view of the integral polepiece RF amplification tube of FIG. 5.

The polepieces 16 have an iris 55 (or notch), according to an embodiment of the present invention, disposed at an edge. As best shown in FIG. 7, the position of the notch 55 in polepiece $\mathbf{16}_1$ appears at the top 23. The next polepiece $\mathbf{16}_2$ has a notch 55 disposed at the bottom 25. The third polepiece $\mathbf{16}_3$ would again feature the notch 55 at the top side 23, similar to that of polepiece $\mathbf{16}_1$. Alternatively, the notch positions could all remain on a single side (the one side 27 or the second side 29), top 23, or bottom 25 of the TWT 20, or could be a combination of the two configurations having a portion of the notches 55 disposed at the top 23 and a portion disposed on the bottom 25. Thus the notch 55 can be arranged in an in-line, staggered, alternating configuration, or any combination of the above or other geometric arrangement. In yet another embodiment, a single polepiece 16 could have more than one notch 55, such as one at both ends of the polepiece 16. FIG. 7 illustrates an exploded view of the integral polepiece RF amplification tube 20 of FIG. 6, and FIG. 8 illustrates a sectional view of the integral polepiece RF amplification tube 20 of FIG. 6.

The notches 55 provide a coupling path for neighboring cavities 56 (see also FIG. 6) formed in the non-magnetic plates 18 that are adjacently positioned relative to the polepieces 16 and alternate with the polepieces 16. The cavity 56 can be shaped, at each end, similar to notch 55 to aid in RF propagation and further the desired characteristics. Thus a continuous path 40, visible in the sectional drawing of FIG. 8, through the tube 20 is provided that utilizes a notch shape according to an embodiment of the present invention as in FIG. 5.

Figure 6A:
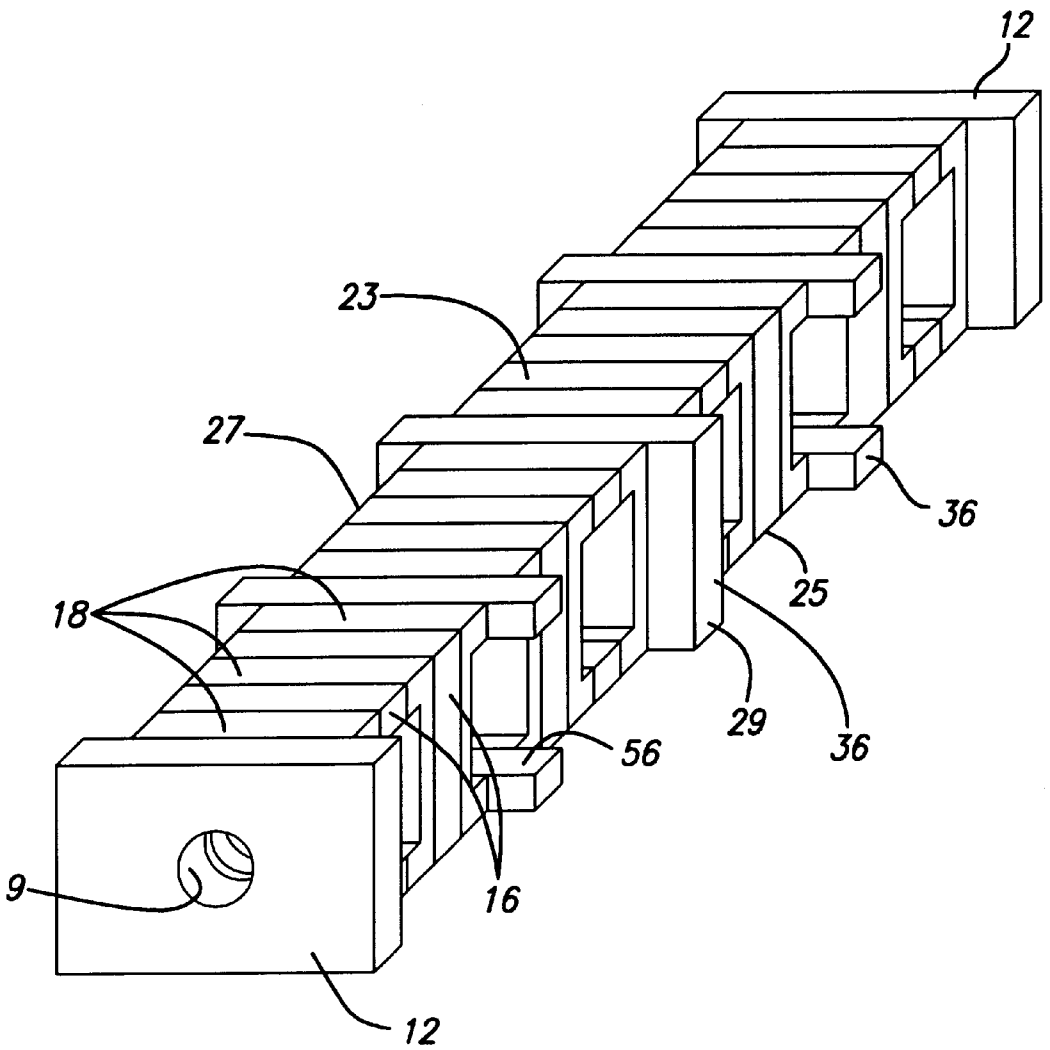
FIG. 6A is a perspective view of an alternative embodiment of an integral polepiece RF amplification tube.

Alternatively, to vary the RF propagation characteristics, the cavity 56 could extend between the one side 27 and the second side 29 rather than the top 23 and the bottom 25 as shown in FIG. 6A. The cavity direction could also alternate between a first direction extending between the top 23 and the bottom 25 and a second direction extending between sides 27 and 29 (not shown). Additionally, it should also be apparent that cavities 56 could be provided in polepieces 16 as well as the non-magnetic plates 18 (not shown). Likewise, the notches 55 could be provided in the non-magnetic plates 18 as well as the polepieces 16 as desired to produce desired tube characteristics (not shown). Therefore, as indicated above, there are a large number of arrangements and layouts for the cavities 56 in relation to the notches 55 that are in accordance with an embodiment of the present invention for the coupled cavity circuit.

It should also be understood that there are many variations of the iris 55 of FIG. 5 that are in accordance with embodiments of the present invention that would provide the required capacitive loading of the iris 55 in order to invert the cavity mode and slot mode passbands. Furthermore, the present invention can be utilized with one or more of the electron beam focusing schemes used in the art today, such as: 1) PPM focusing where the iron polepieces extend directly through to the electron beam tunnel, 2) PPM focusing where the iron polepieces are spaced from the electron beam tunnel, 3) permanent magnet focusing, and 4) solenoid focusing. FIG. 6 illustrated an example of the first type of focusing scheme, referred to as an integral polepiece structure, where the iron polepieces extended directly through to the electron beam tunnel. An example of the second type of focusing scheme, where the iron polepieces are spaced from the electron beam tunnel, is referred to hereinafter as a standard polepiece stack and is shown in FIG. 9.

Figure 9:
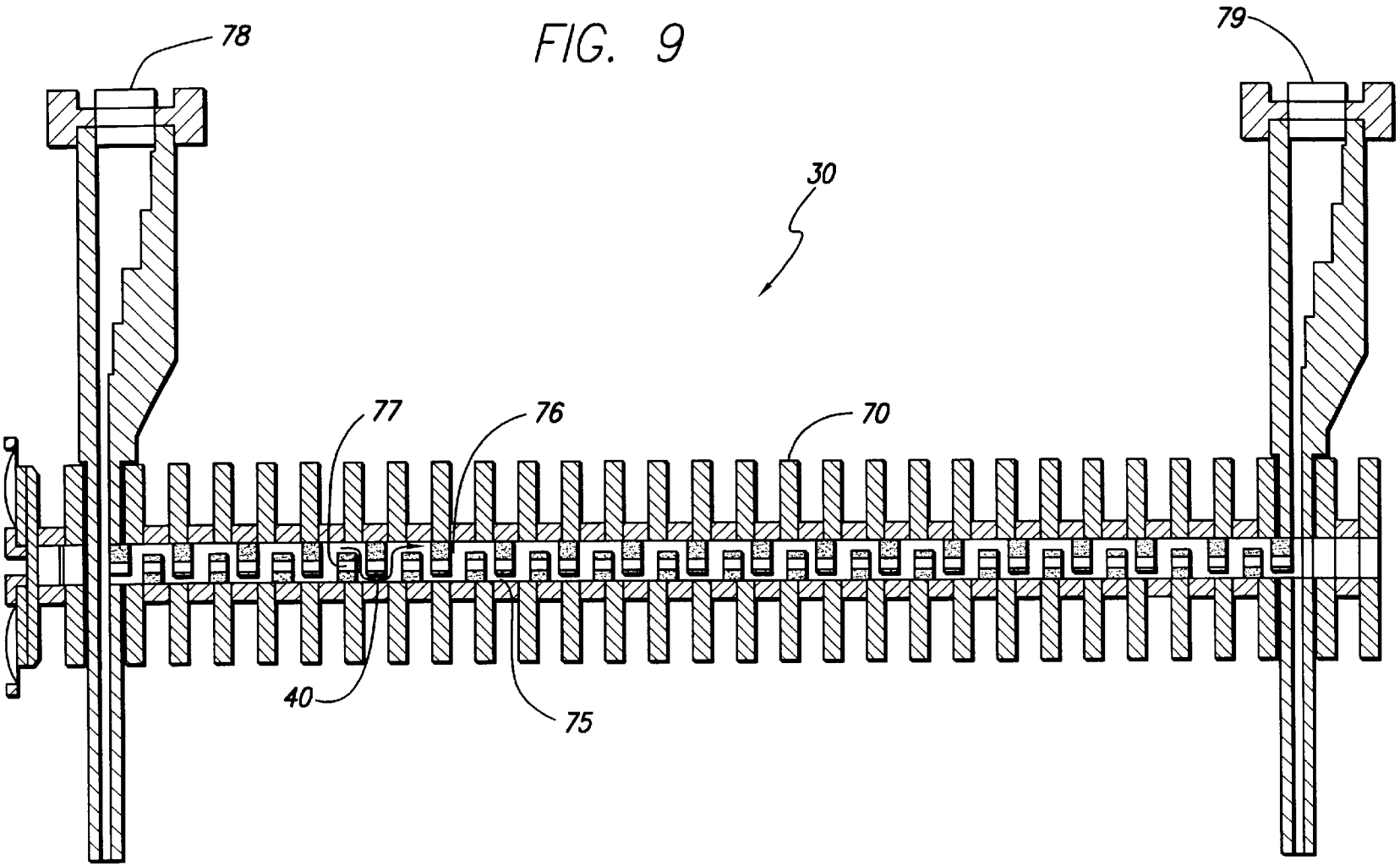
FIG. 9 illustrates a side sectional view of a coupled cavity TWT amplifier with a standard PPM polepiece stack that utilizes an iris according to an embodiment of the present invention.

FIG. 9 illustrates a side sectional view of a coupled cavity TWT 30 with a standard polepiece stack that utilizes an iris according to an embodiment of the present invention. A RF input 78 and a RF output 79 are shown along with a PPM polepiece stack 70 that is spaced from an electron beam tunnel 77. The meandering RF path 40 travels through the tuned cavities 76 that are linked by the irises 75. The irises 75 are shaped according to an embodiment of the present invention as illustrated in FIG. 5. The ends of the tuned cavities 76, near the iris, may also be shaped according to an embodiment of the present invention to facilitate optimal RF propagation, as known in the art. For the TWT 30, the irises 75 and the tuned cavities 76 may be formed as part of a pure copper circuit that is inserted into an assembly that includes the PPM polepiece stack 70.

Using the standard polepiece stack as in FIG. 9 to generate the magnetic field, rather than the integral polepiece structure as in FIG. 6, allows the development of stronger magnetic field levels and the elimination of transverse fields in the electron beam tunnel 77. Furthermore, the standard polepiece stack of FIG. 9 reduces the number of incipient stopbands that result from machining laminated blocks to fabricate the coupled cavity circuit as with the integral polepiece structure of FIG. 6. In designing a lightweight, high-frequency amplifier, the integral polepiece structure may be preferred for low voltage applications while the standard polepiece stack may be preferred for high power applications.

An embodiment of the present invention can also be utilized in conjunction with a klystron. As known in the art, notches can couple a portion of the cavities in a klystron. The notches can be shaped according to an embodiment of the present invention, thus allowing the cavities to operate as an extended interaction output circuit for improved bandwidth.

Figure 10:
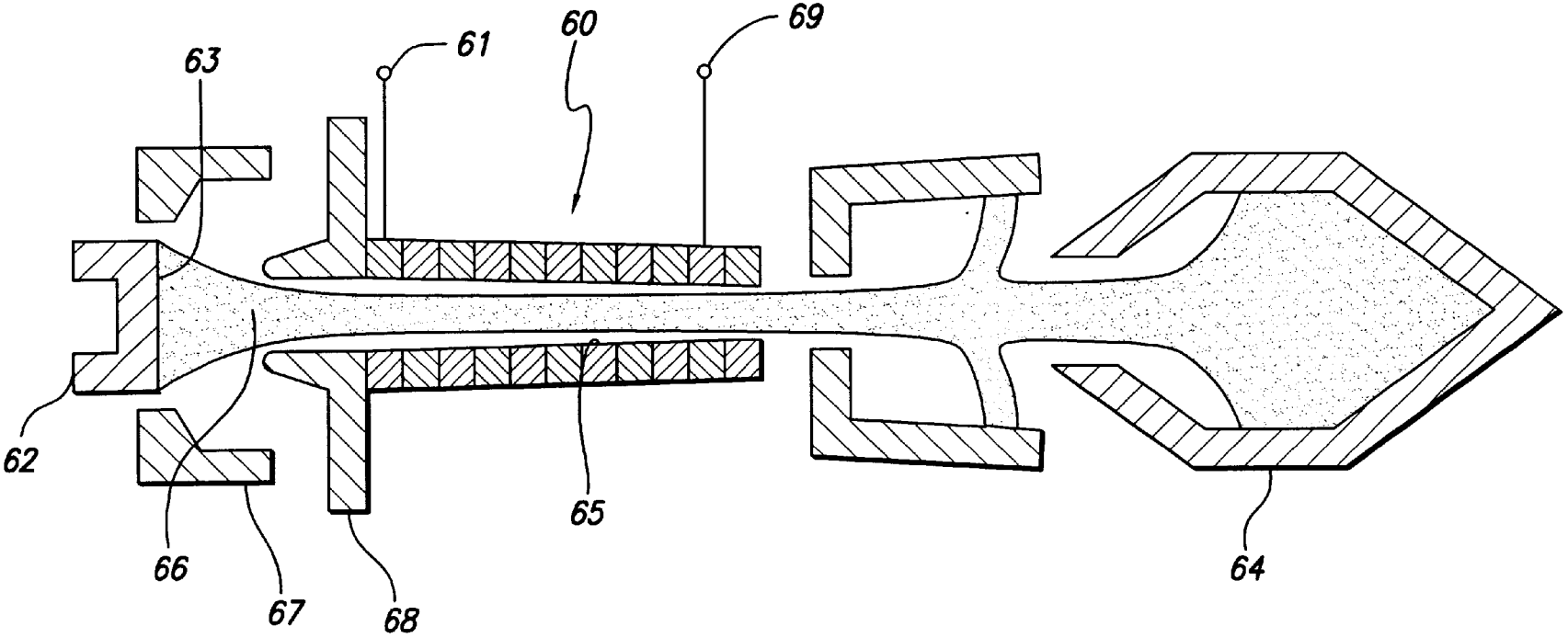
FIG. 10 illustrates a side sectional view of a coupled cavity microwave amplification tube assembled to an electron gun and a collector.

To put the coupled cavity circuit into use, the coupled cavity circuit is placed within an amplification tube, usually along with a number of other similar coupled cavity circuits, to form a complete amplifier assembly. The amplification tube 60, as shown in FIG. 10, can then be assembled to an electron gun 62 and an electron beam collector 64. The electron gun 62 has a cathode 63 that emits electrons. The electrons are focused into an electron beam 66 by focusing electrodes 67 and an anode 68. A magnetic field provided along the electron beam tunnel 65 maintains the focus of the electron beam 66 within the tube 60. The collector 64 receives and dissipates the electrons after they exit the tube 60. A RF input terminal 61 and a RF output terminal 69 are provided for amplification of a RF signal.

Figure 11:
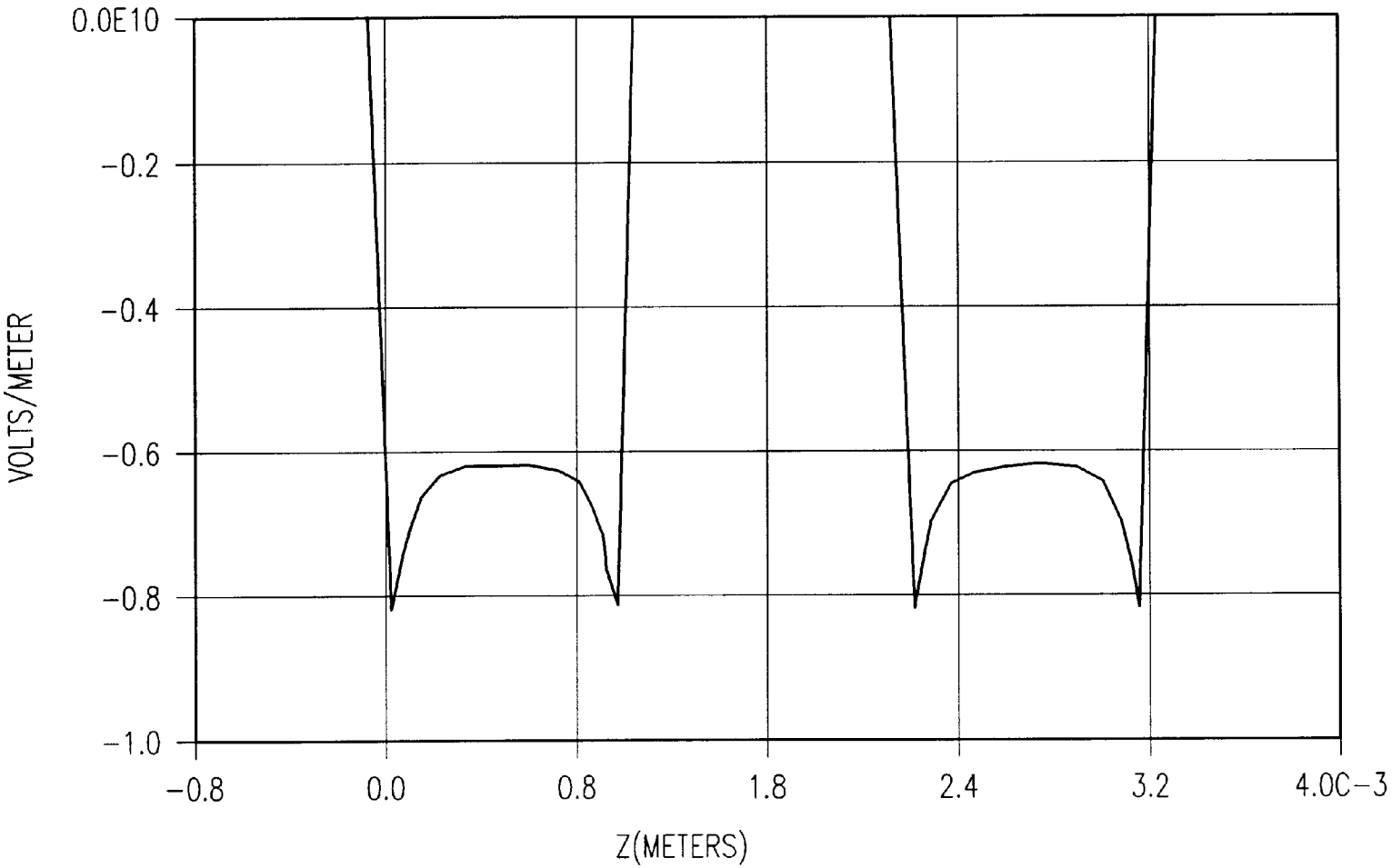
FIG. 11 is a graph illustrating the electric fields across the cavity gap at a cavity resonance frequency for a coupled cavity circuit that utilizes an iris according to an embodiment of the present invention.
Figure 12:
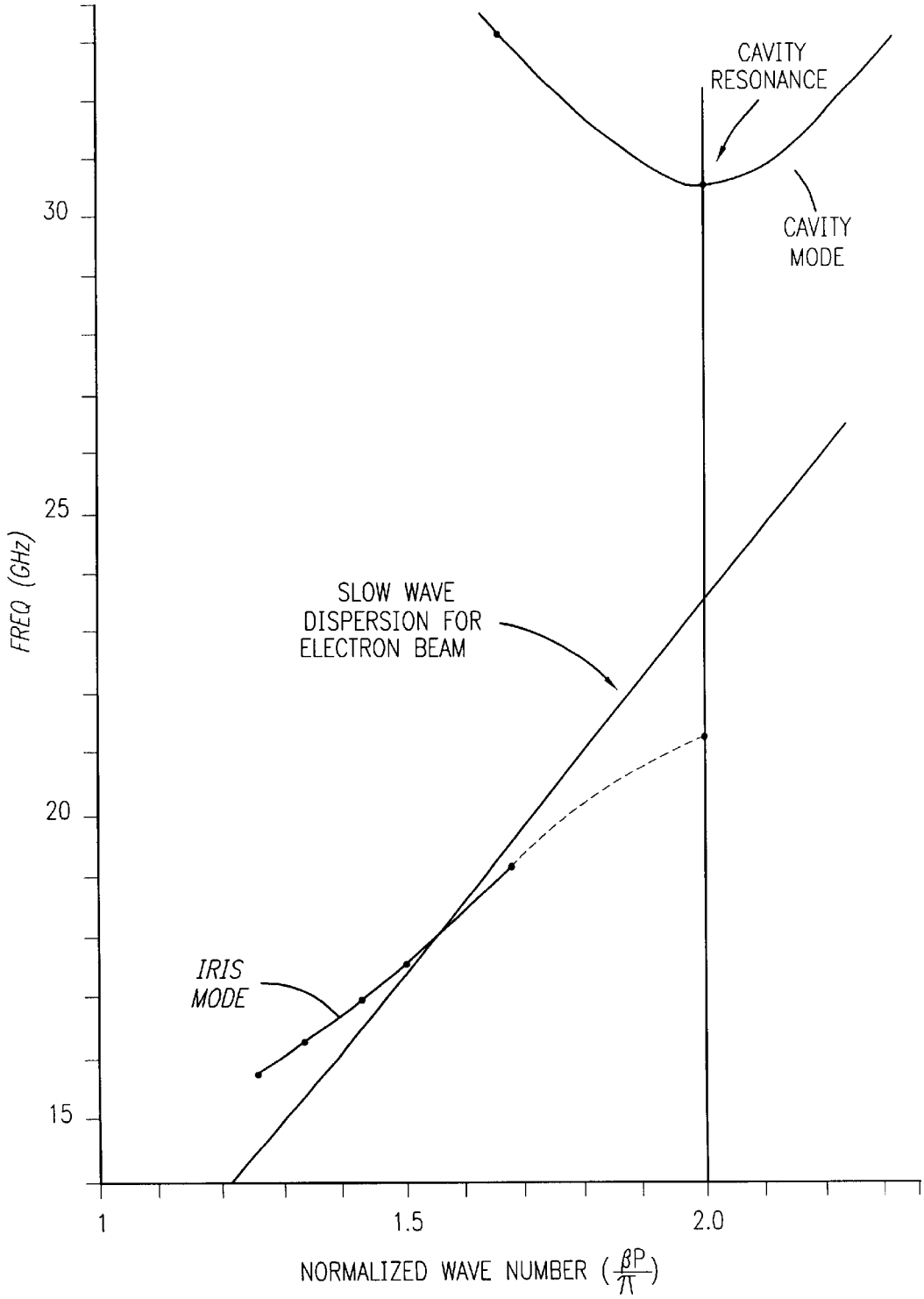
FIG. 12 is a graph plotting the frequency versus the normalized wave number for a coupled cavity circuit that utilizes an iris according to an embodiment of the present invention.

FIGS. 11 and 12 are graphs that provide performance data for a coupled cavity circuit in accordance with an embodiment of the present invention. FIG. 11 plots the axial component of the electric field in the coupled cavity circuit gap for a resonance frequency at 30 GHz. The equal amplitudes that correspond to a $2\pi$ phase shift between cavities identify this as a cavity resonance. This cavity resonance usually must be lossed out when it appears in the same passband as the operating frequencies. In this case, the circuit operates in the Ku frequency band using the iris mode passband. Thus, due to the iris producing passband mode inversion, the operating frequencies are far below the cavity passband that contains the cavity resonance and no lossy material is required inside the coupled cavity circuit.

FIG. 12 plots frequency as a function of the normalized wave number (wave number $\beta$ times the circuit period P divided by $\pi$). The cavity mode passband and iris mode passband are plotted along with the slow wave dispersion for an electron beam. The plot shows how the slow wave circuit dispersion allows a broadband circuit to avoid drive-induced cavity resonances. As the electron beam loses energy during interaction, the phase velocity of the slow space charge waves decreases and the slope of the iris slow wave mode dispersion line drops. In prior art, the line would approach the cavity resonance. For this invention, the line moves away from the cavity resonance. Furthermore, the plot shows that an iris according to an embodiment of the present invention can be utilized not only for the forward wave, but also for the backward wave, as known in the art.

Having thus described a preferred embodiment of the coupled cavity circuit, it should be apparent to those skilled in the art that certain advantages of the within system have been achieved. It should also be appreciated that various modifications, adaptations, and alternative embodiments thereof may be made within the scope and spirit of the present invention. For example, a rectangular waveguide shape has been illustrated to show an embodiment of the present invention, but it should be apparent that the inventive concepts described above would be equally applicable to circular waveguides or other shapes as known in the art. The invention is further defined by the following claims.

What is claimed is:

1. An integral polepiece focusing structure for an RF amplification tube, comprising:

an interaction structure comprising a plurality of magnetic polepieces and a plurality of electrically conductive non-magnetic plates which are alternatingly and integrally coupled into a laminate structure;

means for inducing a magnetic field in said interaction structure having lines of flux which flow through said magnetic polepieces;

an electron beam tunnel extending through said interaction structure, said magnetic polepieces extending substantially entirely to said electron beam tunnel; and wherein said non-magnetic plates each have a respective cavity, each said respective cavity providing a respective resonant cavity, said magnetic polepieces each having at least one respective iris, wherein said at least one iris couples an applied electromagnetic signal between adjacent ones of said resonant cavities, said at least one iris having a center portion with a first width and flared ends each having a second width that is greater than said first width, said flared ends wrapping partially around said electron beam tunnel, said flared ends each further having a side defining an edge of said iris adjacent to said electron beam tunnel that extends to said center portion in a direction substantially intersecting said sidewall such that a portion of a corresponding one of said magnetic polepieces remains between said edge and said electron beam tunnel;

wherein said at least one iris further comprises:

a first iris located on a first side of a first one of said magnetic polepieces and a second iris located on a second side of said first one of said magnetic polepieces;

a third iris located on a first side of a second one of said magnetic polepieces and a fourth iris located on a second side of said second one of said magnetic polepieces; and wherein said third iris is aligned with said first iris and said fourth iris is aligned with said second iris.

2. An integral polepiece focusing structure for an RF amplification tube, comprising:

an interaction structure comprising a plurality of magnetic polepieces and a plurality of electrically conductive non-magnetic plates which are alternatingly and integrally coupled into a laminate structure;

means for inducing a magnetic field in said interaction structure having lines of flux which flow through said magnetic polepieces;

an electron beam tunnel extending through said interaction structure, said magnetic polepieces extending substantially entirely to said electron beam tunnel; and wherein said non-magnetic plates each have a respective cavity, each said respective cavity providing a respective resonant cavity, said magnetic polepieces each having at least one respective iris, wherein said at least one iris couples an applied electromagnetic signal between adjacent ones of said resonant cavities, said at least one iris having a center portion with a first width and flared ends each having a second width that is greater than said first width, said flared ends wrapping partially around said electron beam tunnel, said flared ends each further having a side defining an edge of said iris adjacent to said electron beam tunnel that extends to said center portion in a direction substantially intersecting said sidewall such that a portion of a corresponding one of said magnetic polepieces remains between said edge and said electron beam tunnel;

wherein said at least one iris further comprises:

a first iris located on a first side of a first one of said magnetic polepieces and a second iris located on a second side of said first one of said magnetic polepieces;

a third iris located on a first side of a second one of said magnetic polepieces and a fourth iris located on a second side of said second one of said magnetic polepieces; and wherein said third iris is staggered with respect to said first iris and said fourth iris is staggered with respect to said second iris.

3. A microwave electron tube, comprising:

an electron gun for emitting an electron beam;

a collector spaced from said electron gun, said collector collecting electrons of said electron beam emitted from said electron gun;

an interaction structure defining an electromagnetic path along which an applied electromagnetic signal interacts with said electron beam, said interaction structure further comprising a plurality of alternatingly assembled magnetic and non-magnetic members, said magnetic and non-magnetic members each having an aligned opening providing an electron beam tunnel extending between said electron gun and said collector, said electron beam tunnel defining an electron beam path for said electron beam, said magnetic members providing a magnetic flux path to said electron beam tunnel;

wherein, ones of said magnetic and non-magnetic members further include respective cavities defined therein interconnected to provide a coupled cavity circuit, and wherein other ones of said magnetic and non-magnetic members provide cavity walls separating adjacent ones of said cavities, said cavity walls further having at least one iris for coupling said electromagnetic signal therethrough; and wherein, each said at least one iris is relatively disposed between a corresponding one of said aligned openings and an exterior surface of said coupled cavity circuit, each said at least one iris further having an elongated center portion having a first width, and equal-sized flared ends each having a second width that is greater than said first width, said flared ends wrapping partially around said corresponding one of said aligned openings such that a portion of a corresponding cavity wall remains between said flared ends and said corresponding aligned opening, said interaction structure thereby exhibiting a cavity resonant frequency that is substantially larger than a corresponding iris cut-off frequency, said at least one iris further comprising substantially linear edges defining an outer periphery thereof.

4. The microwave electron tube of claim 3, wherein said flared ends each further include an edge adjacent to said corresponding aligned opening that extends toward said center portion in a direction substantially intersecting said exterior surface of said coupled cavity circuit.

5. The microwave electron tube of claim 3, wherein said interaction structure further comprises an extended interaction output circuit for a klystron.

6. A microwave amplification tube, comprising:

at least one coupled cavity circuit which includes a plurality of solid members and hollow spacer members which are alternately arrayed to define a plurality of resonant cavities, said solid members and said hollow spacer members each having a respective aligned aperture through which an electron beam travels;

means for inducing a magnetic field in said microwave amplification tube to focus said electron beam, said solid members each having a respective coupling iris through which microwave energy is coupled between adjacent ones of said plurality of resonant cavities; and wherein each said respective coupling iris has trapezoidally shaped ends that are joined by a central portion, said central portion disposed between said respective aligned aperture and a corresponding sidewall of said tube, said central portion having a first width that is less than a second width of said trapezoidally shaped ends, said trapezoidally shaped ends each further having a side defining an edge of said coupling iris adjacent to said aligned aperture that extends to said central portion in a direction substantially intersecting said corresponding sidewall such that a portion of a surface of a corresponding one of said solid members remains between said edge and said aligned aperture, each said coupling iris further comprising an outer periphery comprised of substantially linear segments.

7. The microwave amplification tube of claim 6, wherein said tube further comprises a klystron.

8. The microwave amplification tube of claim 6, wherein:

said tube further comprises a coupled cavity traveling wave tube having plural sections; and each one of said plurality of resonant cavities being located in at least one of said sections.

9. The microwave amplification tube of claim 6, wherein positions of respective ones of said irises in said plurality of solid members are staggered from each other.

10. The microwave amplification tube of claim 6, wherein positions of respective ones of said irises in said plurality of solid members alternate between a first edge thereof and a second edge thereof edge.

11. A microwave amplification tube, comprising:

at least one coupled cavity circuit which includes a plurality of solid members and hollow spacer members which are alternately arrayed to define a plurality of resonant cavities, said solid members and said hollow spacer members each having a respective aligned aperture through which an electron beam travels;

means for inducing a magnetic field in said microwave amplification tube to focus said electron beam, said solid members each having a respective coupling iris through which microwave energy is coupled between adjacent ones of said plurality of resonant cavities; and wherein each said respective coupling iris has trapezoidally shaped ends that are joined by a central portion, said central portion disposed between said respective aligned aperture and a corresponding sidewall of said tube, said central portion having a first width that is less than a second width of said trapezoidally shaped ends, said trapezoidally shaped ends each further having a side defining an edge of said coupling iris adjacent to said aligned aperture that extends to said central portion in a direction substantially intersecting said corresponding sidewall such that a portion of a surface of a corresponding one of said solid members remains between said edge and said aligned aperture;

wherein positions of respective ones of said irises in said plurality of solid members are aligned with respect to each other.

12. A microwave amplification tube, comprising:

at least one coupled cavity circuit which includes a plurality of solid members and hollow spacer members which are alternately arrayed to define a plurality of resonant cavities, said solid members and said hollow spacer members each having a respective aligned aperture through which an electron beam travels;

means for inducing a magnetic field in said microwave amplification tube to focus said electron beam, said solid members each having a respective coupling iris through which microwave energy is coupled between adjacent ones of said plurality of resonant cavities; and wherein each said respective coupling iris has trapezoidally shaped ends that are joined by a central portion, said central portion disposed between said respective aligned aperture and a corresponding sidewall of said tube, said central portion having a first width that is less than a second width of said trapezoidally shaped ends, said trapezoidally shaped ends each further having a side defining an edge of said coupling iris adjacent to said aligned aperture that extends to said central portion in a direction substantially intersecting said corresponding sidewall such that a portion of a surface of a corresponding one of said solid members remains between said edge and said aligned aperture;

wherein each one of said plurality of solid members further comprises at least two irises.

13. A microwave electron tube, comprising:

an electron gun for emitting an electron beam;

a collector spaced from said electron gun, said collector collecting electrons of said electron beam emitted from said electron gun;

an interaction structure defining an electromagnetic path along which an applied electromagnetic signal interacts with said electron beam, said interaction structure further comprising a plurality of alternatingly assembled magnetic and non-magnetic members, said magnetic and non-magnetic members each having an aligned opening providing an electron beam tunnel extending between said electron gun and said collector, said electron beam tunnel defining an electron beam path for said electron beam, said magnetic members providing a magnetic flux path to said electron beam tunnel;

wherein, ones of said magnetic and non-magnetic members further include respective cavities defined therein interconnected to provide a coupled cavity circuit, and wherein other ones of said magnetic and non-magnetic members provide cavity walls separating adjacent ones of said cavities, said cavity walls further having at least one iris for coupling said electromagnetic signal therethrough; and wherein, each said at least one iris is relatively disposed between a corresponding one of said aligned openings and an exterior surface of said coupled cavity circuit, each said at least one iris further having an elongated center portion having a first width, and equal-sized flared ends each having a second width that is greater than said first width, said flared ends wrapping partially around said corresponding one of said aligned openings such that a portion of a corresponding cavity wall remains between said flared ends and said corresponding aligned opening, said interaction structure thereby exhibiting a cavity resonant frequency that is substantially larger than a corresponding iris cut-off frequency;

wherein said at least one iris further comprising a first plurality of irises disposed on a first side of interaction structure and a second plurality of irises disposed on a second side of interaction structure.

14. A microwave electron tube, comprising:

an electron gun for emitting an electron beam;

a collector spaced from said electron gun, said collector collecting electrons of said electron beam emitted from said electron gun;

an interaction structure defining an electromagnetic path along which an applied electromagnetic signal interacts with said electron beam, said interaction structure further comprising a plurality of alternatingly assembled magnetic and non-magnetic members, said magnetic and non-magnetic members each having an aligned opening providing an electron beam tunnel extending between said electron gun and said collector, said electron beam tunnel defining an electron beam path for said electron beam, said magnetic members providing a magnetic flux path to said electron beam tunnel;

wherein, ones of said magnetic and non-magnetic members further include respective cavities defined therein interconnected to provide a coupled cavity circuit, and wherein other ones of said magnetic and non-magnetic members provide cavity walls separating adjacent ones of said cavities, said cavity walls further having at least one iris for coupling said electromagnetic signal therethrough; and wherein, each said at least one iris is relatively disposed between a corresponding one of said aligned openings and an exterior surface of said coupled cavity circuit, each said at least one iris further having an elongated center portion having a first width, and equal-sized flared ends each having a second width that is greater than said first width, said flared ends wrapping partially around said corresponding one of said aligned openings such that a portion of a corresponding cavity wall remains between said flared ends and said corresponding aligned opening, said interaction structure thereby exhibiting a cavity resonant frequency that is substantially larger than a corresponding iris cut-off frequency;

wherein, said coupled cavity circuit has a substantially rectangular shape having plural external surfaces including said external surface; and said center portion of said at least one iris has a rectangular shape that extends substantially across a first one of said plural external surfaces of said coupled cavity circuit, said flared ends defining a substantially trapezoidal shape at each end of said center portion.

15. An integral polepiece focusing structure for an RF amplification tube, comprising:

an interaction structure comprising a plurality of magnetic polepieces and a plurality of electrically conductive non-magnetic plates which are alternatingly and integrally coupled into a laminate structure, said plurality of magnetic polepieces and plurality of non-magnetic plates each having a respective aligned opening providing an electron beam tunnel, said magnetic polepieces thereby providing a magnetic flux path directly to said electron beam tunnel;

wherein said non-magnetic plates each have a respective cavity, each said respective cavity providing a respective resonant cavity, said magnetic polepieces each having at least one respective iris, wherein each said iris couples an applied electromagnetic signal between adjacent ones of said resonant cavities, each said iris being having a center portion with a first width and flared ends each having a second width that is greater than said first width, said flared ends wrapping partially around said respective aligned opening such that a portion of a corresponding one of said non-magnetic plates remains between said flared ends and said respective aligned opening, said interaction structure thereby exhibiting a cavity resonant frequency that is substantially larger than a corresponding iris cut-off frequency; and wherein positions of respective ones of said irises in said magnetic plates are aligned with respect to each other.

16. An integral polepiece focusing structure for an RF amplification tube, comprising:

an interaction structure comprising a plurality of magnetic polepieces and a plurality of electrically conductive non-magnetic plates which are alternatingly and integrally coupled into a laminate structure, said plurality of magnetic polepieces and plurality of non-magnetic plates each having a respective aligned opening providing an electron beam tunnel, said magnetic polepieces thereby providing a magnetic flux path directly to said electron beam tunnel;

wherein said non-magnetic plates each have a respective cavity, each said respective cavity providing a respective resonant cavity, said magnetic polepieces each having at least one respective iris, wherein each said iris couples an applied electromagnetic signal between adjacent ones of said resonant cavities, each said iris being having a center portion with a first width and flared ends each having a second width that is greater than said first width, said flared ends wrapping partially around said respective aligned opening such that a portion of a corresponding one of said non-magnetic plates remains between said flared ends and said respective aligned opening, said interaction structure thereby exhibiting a cavity resonant frequency that is substantially larger than a corresponding iris cut-off frequency; and wherein said at least one iris further comprising a first plurality of irises disposed on a first side of said interaction structure and a second plurality of irises disposed on a second side of said interaction structure.

17. An integral polepiece focusing structure for an RF amplification tube, comprising:

an interaction structure comprising a plurality of magnetic polepieces and a plurality of electrically conductive non-magnetic plates which are alternatingly and integrally coupled into a laminate structure;

means for inducing a magnetic field in said interaction structure having lines of flux which flow through said magnetic polepieces;

an electron beam tunnel extending through said interaction structure, said magnetic polepieces extending substantially entirely to said electron beam tunnel; and wherein said non-magnetic plates each have a respective cavity, each said respective cavity providing a respective resonant cavity, said magnetic polepieces each having at least one respective iris, wherein said at least one iris couples an applied electromagnetic signal between adjacent ones of said resonant cavities, said at least one iris having a center portion with a first width and flared ends each having a second width that is greater than said first width, said flared ends wrapping partially around said electron beam tunnel, said flared ends each further having a side defining an edge of said iris adjacent to said electron beam tunnel that extends to said center portion in a direction substantially intersecting said sidewall such that a portion of a corresponding one of said magnetic polepieces remains between said edge and said electron beam tunnel, said at least one iris further comprising an outer periphery comprised of substantially linear segments.

18. The integral polepiece focusing structure of claim 17, wherein positions of respective ones of said irises in said magnetic plates are staggered with respect to each other.

19. The integral polepiece focusing structure of claim 17, wherein positions of respective ones of said irises in said magnetic plates alternate between a first edge thereof and a second edge thereof opposite to said first edge.

20. The integral polepiece focusing structure of claim 17, wherein said at least one iris further comprises at least two irises.

21. The integral polepiece focusing structure of claim 17, wherein said tube further comprises a klystron.

22. The integral polepiece focusing structure of claim 17, wherein:

said tube further comprises a coupled cavity traveling wave tube having plural sections; and each said resonant cavity coupled by a respective one of said irises is located in at least one of said sections.

23. An integral polepiece focusing structure for an RF amplification tube, comprising:

an interaction structure comprising a plurality of magnetic polepieces and a plurality of electrically conductive non-magnetic plates which are alternatingly and integrally coupled into a laminate structure;

means for inducing a magnetic field in said interaction structure having lines of flux which flow through said magnetic polepieces;

an electron beam tunnel extending through said interaction structure, said magnetic polepieces extending substantially entirely to said electron beam tunnel; and wherein said non-magnetic plates each have a respective cavity, each said respective cavity providing a respective resonant cavity, said magnetic polepieces each having at least one respective iris, wherein said at least one iris couples an applied electromagnetic signal between adjacent ones of said resonant cavities, said at least one iris having a center portion with a first width and flared ends each having a second width that is greater than said first width, said flared ends wrapping partially around said electron beam tunnel, said flared ends each further having a side defining an edge of said iris adjacent to said electron beam tunnel that extends to said center portion in a direction substantially intersecting said sidewall such that a portion of a corresponding one of said magnetic polepieces remains between said edge and said electron beam tunnel, wherein positions of respective ones of said irises in said magnetic plates are aligned with respect to each other.

24. An integral polepiece focusing structure for an RF amplification tube, comprising:

an interaction structure comprising a plurality of magnetic polepieces and a plurality of electrically conductive non-magnetic plates which are alternatingly and integrally coupled into a laminate structure, said plurality of magnetic polepieces and plurality of non-magnetic plates each having a respective aligned opening providing an electron beam tunnel, said magnetic polepieces thereby providing a magnetic flux path directly to said electron beam tunnel; and wherein said non-magnetic plates each have a respective cavity, each said respective cavity providing a respective resonant cavity, said magnetic polepieces each having at least one respective iris, wherein each said iris couples an applied electromagnetic signal between adjacent ones of said resonant cavities, each said iris being having a center portion with a first width and flared ends each having a second width that is greater than said first width, said flared ends wrapping partially around said respective aligned opening such that a portion of a corresponding one of said non-magnetic plates remains between said flared ends and said respective aligned opening, said interaction structure thereby exhibiting a cavity resonant frequency that is substantially larger than a corresponding iris cut-off frequency, said at least one iris further comprising substantially linear edges defining an outer periphery thereof.

25. The integral polepiece focusing structure of claim 24, wherein positions of respective ones of said irises in said magnetic plates are staggered with respect to each other.

26. The integral polepiece focusing structure of claim 24, wherein positions of respective ones of said irises in said magnetic plates alternates between a first edge thereof and a second edge thereof opposite to said first edge.

27. The integral polepiece focusing structure of claim 24, wherein said tube further comprises a klystron.

28. The integral polepiece focusing structure of claim 24, wherein said flared ends each further include an edge adjacent to said corresponding aligned opening that extends toward said center portion in a direction substantially intersecting an exterior surface of said interaction structure.

* * * * *